US007144226B2

(12) United States Patent
Pugnet et al.

(10) Patent No.: US 7,144,226 B2
(45) Date of Patent: Dec. 5, 2006

(54) CENTRIFUGAL COMPRESSOR HAVING A FLEXIBLE COUPLING

(75) Inventors: Jean-Marc Pugnet, Le Creusot (FR); Patrick Friez, Le Creusot (FR); Pierre Laboube, Saint Sernin-du-Bois (FR)

(73) Assignee: Thermodyn, Courbevoie (FR)

( * ) Notice: Subject to any disclaimer, the term of this patent is extended or adjusted under 35 U.S.C. 154(b) by 211 days.

(21) Appl. No.: 10/411,239

(22) Filed: Apr. 11, 2003

(65) Prior Publication Data

US 2004/0179961 A1 Sep. 16, 2004

(30) Foreign Application Priority Data

Mar. 10, 2003 (FR) ..... PCT/FR03/00768

(51) Int. Cl.
*F04B 17/03* (2006.01)
*F04B 25/00* (2006.01)

(52) U.S. Cl. ..... 417/244; 417/423.1; 417/423.12

(58) Field of Classification Search ..... 417/423.12, 417/313, 423.1, 319, 244, 359
See application file for complete search history.

(56) References Cited

U.S. PATENT DOCUMENTS 2,047,986 A * 7/1936 Wineman ..... 417/71
3,174,352 A * 3/1965 Jekat ..... 74/410
3,942,908 A * 3/1976 Pilarczyk ..... 415/199.2
4,969,803 A * 11/1990 Turanskyj ..... 417/247
6,375,438 B1 * 4/2002 Seo ..... 417/366
6,464,469 B1 * 10/2002 Grob et al. ..... 417/251
2002/0037772 A1 3/2002 Fisch et al.

FOREIGN PATENT DOCUMENTS

| | | |
|---|---|---|
| EP | 0 301 285 | 2/1989 |
| EP | 0 301 285 A1 * | 10/2002 |
| GB | 282113 | 3/1928 |
| GB | 1068004 | 5/1967 |
| WO | WO 97/23731 | 7/1997 |

* cited by examiner

*Primary Examiner*—Charles G. Freay
(74) *Attorney, Agent, or Firm*—Young & Thompson

(57) ABSTRACT

This compressor unit comprises a motor (34) and at least one compressor (44) comprising a driven shaft (54) driven by the rotor of the motor and bladed wheels fitted on the driven shaft (54), the assembly composed of the motor and the compressor being installed in a common casing (55) leak tight to the gas manipulated by the compressor unit. The rotor and the driven shaft are connected through a flexible coupling (72) placed in the casing.

19 Claims, 3 Drawing Sheets

CENTRIFUGAL COMPRESSOR HAVING A FLEXIBLE COUPLING

BACKGROUND OF THE INVENTION

The invention relates to a turbocompressor or motor-compressor, and particularly to an integrated motor compressor unit.

With reference to FIG. 1, integrated motor-compressor units comprise a sealed common casing 10 in which there is an electric motor 12 and a compressor unit 14, for example a multi-stage compressor unit, which comprises a set of bladed wheels like the bladed wheel 16 fitted on a shaft 18. The motor 12 drives a rotor 20 in rotation, this rotor 20 being coupled to the shaft 18 of the compressor 14 through a rigid coupling 22. Bearings 24, 26 and 28 are used to support the shaft line of the motor compressor unit. The assembly is placed in a common casing 29.

During operation, the gas to be manipulated is present at the inlet E of the turbocompressor and is then transmitted to the successive compression stages of the compressor unit to be delivered at the outlet S. An axial bearing block 30 is used to prevent axial displacement of the compressor 14 during operation.

This type or arrangement has the advantage that it considerably simplifies the shaft line of the compressor unit to the extent that the assembly consisting of the motor, its rotor and end bearing blocks, and the rigid coupling and the axial thrust bearing, are located inside the casing and are subjected to the gas pressure at the inlet to the first compression stage. Furthermore, with this type of arrangement, it is possible to provide the shaft line with several compression stages while limiting its length.

However, this type of structure has a major disadvantage to the extent that when it is assembled, the rotor and the shaft driven by the compressor have to be perfectly aligned. Furthermore, fixing the rotor and the compressor shaft considerably degrades the vibrational behaviour of the shaft line.

SUMMARY OF THE INVENTION

Therefore the purpose of this invention is to overcome these disadvantages.

Therefore, the purpose of the invention is a centrifugal compressor unit comprising a motor, at least one compressor comprising a driven shaft, driven by the rotor of the motor and a set of at least two bladed wheels fitted on the driven shaft, the assembly composed of the motor and the compressor being installed in a common casing leak tight to the gas manipulated by the compressor unit.

The rotor and the driven shaft are connected through a flexible coupling placed in the casing.

It can then be seen that it is then possible to eliminate the alignment problems of the driving and driven shafts that would make it impossible to use this system. Furthermore, the vibrational behaviours specific to the rotor and the compressor shaft are unchanged, to the extent that these elements in the shaft line of the compressor unit remain mechanically uncoupled.

According to another characteristic of the invention, the casing comprises several casing elements fixed to each other in a leak tight manner, each element of the casing containing the motor or a compressor.

In order to facilitate assembly, the casing is provided with an orifice formed between adjacent casing elements to provide access to the flexible coupling, the said orifice being provided with sealed closing means.

In different embodiments, the flexible coupling comprises a diaphragm coupling or a flexible strip coupling or a torsionally flexible shaft coupling.

Preferably, each end of the driven shaft and the rotor is supported on an end bearing that may be fixed to the casing. For example, the end bearings may be radial magnetic bearings.

According to another characteristic of the invention, the compressor unit comprises a thrust bearing that resists the force applied by the driven shaft of the compressor during operation of the turbocompressor. For example, this thrust bearing may be a magnetic thrust bearing.

BRIEF DESCRIPTION OF THE DRAWINGS

Other purposes, characteristics and advantages of the invention will become clear after reading the following description given as a non-limitative example only, with reference to the attached drawings in which.

DESCRIPTION OF THE PREFERRED EMBODIMENTS

Figure 1:
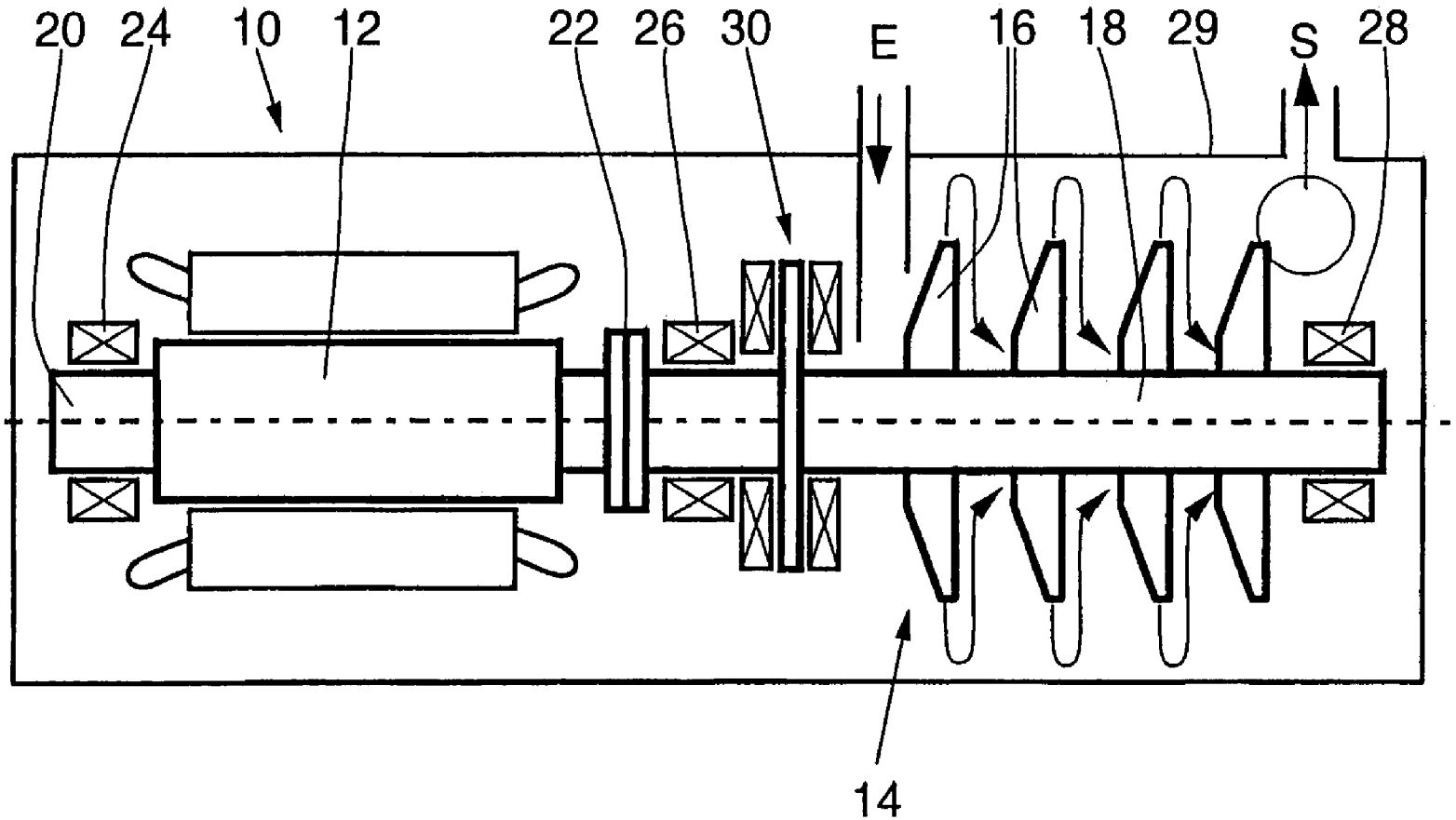
FIG. 1 PRIOR ART
FIG. 1, as already mentioned, illustrates the general structure of a compressor unit according to the state of the art.
Figure 2:
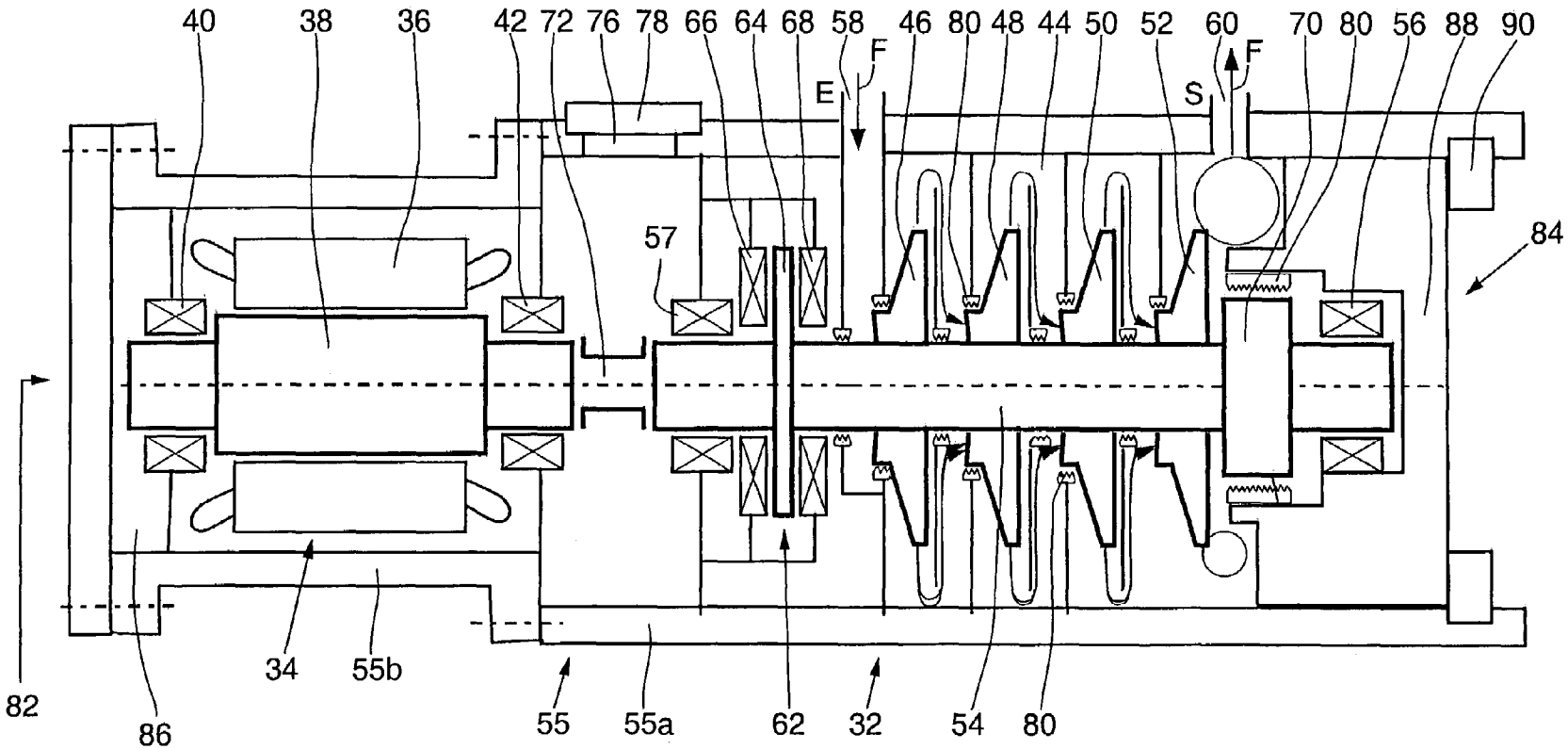
FIG. 2 is a block diagram illustrating the general structure of a compressor unit according to the invention.

With reference to FIG. 2, a motor-compressor conform with the invention, denoted by the general numeric reference 32, comprises essentially an electric motor 34 with a high rotation speed (6000 to 16000 rpm) supplied by a frequency variator and comprising a stator 36 and a rotor 38 supported by two end bearings 40 and 42, and a compressor unit 44 comprising a set of bladed wheels 46, 48, 50 and 52, installed on a driven shaft 54. The assembly is installed on a base (not shown) and is arranged in a common casing 55 tight to the gas manipulated by the turbocompressor.

Obviously, the motor compressor unit 44 may comprise an arbitrary number of such bladed wheels, or as described below, may comprise a different arrangement of bladed wheels.

As can be seen in FIG. 2, the casing is composed of an assembly of casing elements fixed together such as 55*a* and 55*b*, each providing the support and protection of the motor or a compression stage and fixed together by appropriate attachment means.

The compressor shaft 44 turns in the bearings 56 and 57. A gas inlet orifice 58 in the turbocompressor 32 formed in the casing opens out at the first compression stage, composed of the bladed wheel denoted as reference 46, whereas an outlet orifice 60 collects gas manipulated by the turbocompressor at the outlet from the last compression stage consisting of the bladed wheel denoted as numeric reference 52, and denoted by arrows F.

In order to resist forces generated during operation of the compression stage 44, a thrust bearing 62 fixed to the driven shaft is arranged between two fixed bearings 66 and 68 to limit the axial projection distance of the driven shaft 54 in the compressor stage 44, together with an aerodynamic axial balancing piston 70.

A flexible coupling 72 couples the rotor 38 of the motor 34 and the driven shaft 54 of the compressor stage 44. This coupling 72 may be made either on a diaphragm type coupling, or a flexible blade type coupling, or a torsionally flexible shaft type coupling. However, any other type of flexible coupling appropriate for the envisaged use could be used. However, note that the use of a torsionally flexible shaft type coupling to reduce losses by ventilation can reduce the amplitude of generated noise and more easily propagate the axial thrust generated by the motor.

To access this coupling 72, the casing is provided with an orifice 76 that opens out facing the junction area between the rotor 38 and the driven shaft 54. This orifice is combined with a removable sealed closing device 78.

Finally, note that the inside part of the turbocompressor is surrounded by process gas manipulated by the compressor, including the flexible coupling 72. In particular, the internal volume of the turbocompressor has no output shaft seal, but only rotating seals 80 that are subjected to small pressure differences, for example like labyrinth type rotating seals used for operation of the compressor. The motor is left at the compressor inlet pressure in order to limit ventilation losses, and gas is circulated for cooling.

Note also that the radial bearings 40, 42, 56 and 57 used to support the rotors do not need any supply of lubrication fluid. If active magnetic bearings are used, these bearings are controlled so that they can adapt to the dynamic behaviour of the rotor or the driven shaft 53 that they support, in other words they are generally rigid at the motor end and generally flexible at the driven shaft end.

The bearings 40, 42, 56 and 57 are rigidly fixed to the casing, in order to transmit the forces related to operation of the compressor unit to the casing. These forces are composed of radial forces due to gravity, dynamic radial forces due to residual out-of-balance masses, and axial forces due to the resultant of the aerodynamic thrust on the compression stages. These bearings also enable radial displacement of the rotor or the driven shaft that they support, in order to align these elements of the shaft line during maintenance phases.

As mentioned above, the casing consists of an assembly of casing elements supporting the motor and the compression stage respectively, these casing elements being rigidly associated in a leak tight manner. The mutually opposite ends 82 and 84 of the casing thus formed are closed off, firstly by a bolted bottom 86 on which the bearings 40 of the rotor 38 are fixed, and secondly by a second bottom 88 that supports the bearing 56 in which the driven shaft 54 and the balancing piston 70 rotate, and which is fixed for example on the casing by means of shear rings 90.

As it is designed, the invention that has just been described that uses an electric motor and a compressor unit arranged in a leak tight common casing and for which the driving and the driven shafts are fixed using a flexible coupling arranged in the gas manipulated by the turbo compressor, has several advantages.

Firstly, in terms of the mechanical design, each of the rotors (the motor and the compressor unit) has its own specific vibrational behaviour. It will be noted that the motor rotor is usually of the rigid type, with the first critical bending speed above the rotation speed. The compressor rotor is usually of the flexible type, with the first critical bending speed below the maximum rotation speed. The result is that natural bending modes coupled between the two rotors might cause hot points on the motor rotor during operation, forming thermal out-of-balance masses with uncontrollable phase and amplitude.

Furthermore, dynamic balancing of the two rotors is facilitated as a result of the decoupling thus achieved.

The presence of a flexible coupling also facilitates positioning of the first natural frequency in torsion, and also contributes to reducing forces at the compressor shaft end in the case of an electric short circuit at the motor terminals.

Furthermore, in terms of maintenance, the flexible coupling may be uncoupled from the orifice 76 passing through the casing, and either the rotor or the driven shaft may be extracted while the other remains supported by its two bearings. In this way, the rotor and the driven shaft are protected during this operation, reassembly is much faster and alignment and dynamic balancing are made easier due to access to the two central planes of each shaft end.

Furthermore, the use of a bolted bottom at one end and a bottom retained by shear rings at the other end to close off the casing, facilitates disassembly of the turbocompressor. To make this disassembly, the first step is to remove the bolted bottom 86 and extract the motor unit 34.

The compressor unit 44 is arranged such that the entire rotor-diaphragm assembly can be drawn out from the body at the same time as the bottom 88, without needing to separate the casing from its base and from the process gas pipes. It will be noted that during these assembly-disassembly phases, the rotors are supported on their corresponding bearings without any risk of damage to rotating parts and stator parts that could otherwise come into contact with the rotors during these operations.

Finally, it will be noted that the invention is not limited to the embodiment described.

It can be seen that FIG. 2 shows a turbocompressor fitted with a multi-stage compressor integrated in line with a single compression section and four stages. The invention is also applicable to other types of motor-compressors, for example with two sections S1 and S2 in line, for example with two stages each, each of them compressing a process gas, for example with intermediate cooling. In this case, two inlets E'1 and E'2 and two outlets S'1 and S'2 would be provided facing the inlet and the outlet of each of these sections (FIG. 3) in the casing.

Figure 3:
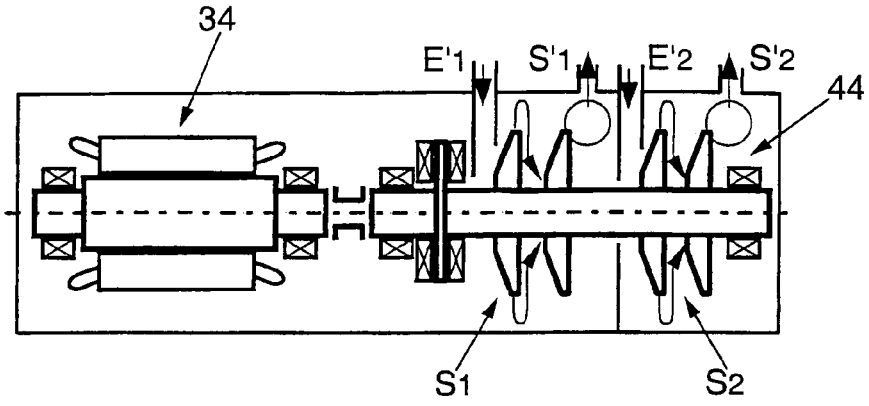
FIG. 3 illustrates another embodiment of a compressor unit according to the invention.

In this case, as can be seen in this FIG. 3, the first compression stage in one of the sections S2 may be arranged facing the second compression stage in the other section S1.

Figure 4:
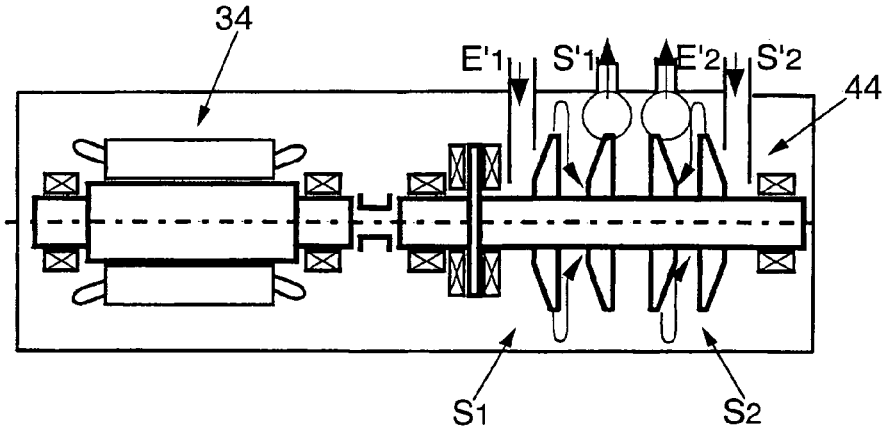
FIG. 4 illustrates a third embodiment of a compressor unit according to the invention.

On the contrary, as can be seen in FIG. 4, the first compression stages in each of the sections S1 and S2 may be arranged back to back.

Figure 5:
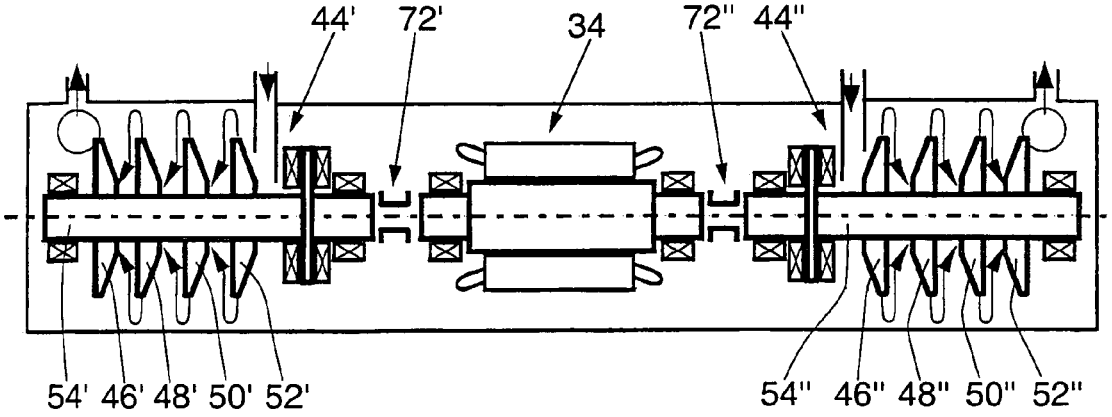
FIG. 5 illustrates a fourth embodiment of a compressor unit according to the invention.

Finally, as can be seen in FIG. 5, it will be noted that the invention is also applicable to an arrangement in which a motor 34 and two compressor units 44' and 44" are arranged in a common casing, each being provided with compression stages 46', 48', 50', 52' and 46", 48", 50" and 52" each fixed on a driven shaft 54' and 54", these shafts 54' and 54" being fixed at the two mutually opposite ends of the rotor 38 of the motor using flexible couplings 72' and 72". Obviously, this arrangement with two compression units can use either of the compression arrangements described previously with reference to FIGS. 2 to 4.

In this case, according to this arrangement by which compressor units are arranged on each side of the motor, the pressure in the motor will be the intake pressure at the low pressure end.

It is also possible that each of the compression bodies will have gas extraction means or reinjection devices, which then considerably increase the number of combinations of possible arrangements.

Finally, note that the invention that has just been described prevents all gas leaks towards the outside, in addition to keeping the dynamic characteristics of rotors unchanged.

It is also a means of eliminating seals and their auxiliary monitoring systems.

The invention claimed is:

1. Centrifugal compressor unit comprising a motor (34), at least one compressor (44; 44', 44") comprising a driven shaft (54; 54', 54") driven by a rotor (38) of the motor and a set of bladed wheels fitted on the driven shaft, an assembly composed of the motor and the compressor being installed in a common casing (55) leak tight to the gas manipulated by the compressor unit, characterised in that the rotor and the driven shaft are connected through a flexible coupling (72; 72', 72") placed in the casing, and characterized in that each end of the driven shaft and the rotor is supported on an end bearing (40, 42, 55, 56) which suspends the respective end.

2. Compressor unit according to claim 1, characterised in that the casing comprises several casing elements (55*a*, 55*b*) fixed to each other in a leak tight manner, each element of the casing containing the motor or a compressor.

3. Compressor unit according to claim 2, characterised in that the casing is provided with an orifice (76) formed between adjacent casing elements to provide access to the flexible coupling, the said orifice being provided with sealed closing means (78).

4. Compressor unit according to claim 1, characterised in that the flexible coupling (72, 72', 72") comprises an element chosen from among a diaphragm coupling, a flexible strip coupling or a torsionally flexible shaft coupling.

5. Compressor unit according to claim 1, characterised in that each end bearing (40, 42, 55, 56) is fixed to the casing.

6. Compressor unit according to claim 1, characterised in that the end bearings are radial magnetic bearings.

7. Compressor unit according to claim 1, characterised in that it comprises a thrust bearing (62) that resists the force applied by the driven shaft of the compressor, during operation of the turbocompressor.

8. Compressor unit according to claim 7, characterised in that the thrust bearing (62) is a magnetic thrust bearing.

9. Compressor unit according to claim 2, characterised in that the flexible coupling (72, 72', 72") comprises an element chosen from among a diaphragm coupling, a flexible strip coupling or a torsionally flexible shaft coupling.

10. Compressor unit according to claim 3, characterised in that the flexible coupling (72, 72', 72") comprises an element chosen from among a diaphragm coupling, a flexible strip coupling or a torsionally flexible shaft coupling.

11. Compressor unit according to claim 2, characterised in that each end of the driven shaft and the rotor is supported on an end bearing (40, 42, 55, 56).

12. Compressor unit according to claim 3, characterised in that each end of the driven shaft and the rotor is supported on an end bearing (40, 42, 55, 56).

13. Compressor unit according to claim 4, characterised in that each end of the driven shaft and the rotor is supported on an end bearing (40, 42, 55, 56).

14. Compressor unit according to claim 5, characterised in that the end bearings are radial magnetic bearings.

15. Compressor unit according to claim 5, characterised in that it comprises a thrust bearing (62) that resists the force applied by the driven shaft of the compressor, during operation of the turbocompressor.

16. A centrifugal compressor unit, comprising:

an electric motor comprising a driving rotor;

at least one compressor comprising a driven shaft and a set of bladed wheels fitted on the driven shaft;

a flexible coupling connected to the rotor and to the driven shaft so that the rotor drives the driven shaft via the flexible coupling; and a common casing, wherein, an assembly comprised of the motor, the flexible coupling, and the compressor are installed in the common casing leak tight to gas manipulated by the compressor unit, with the flexible coupling placed in the common casing and the gas surrounding the compressor and the flexible coupling, and each end of the driven shaft and the rotor is supported on an end bearing (40, 42, 55, 56) which suspends the respective end.

17. The unit of claim 16, wherein the coupling is one of the group consisting of a diaphragm coupling, a flexible blade coupling, and a torsionally flexible shaft coupling.

18. The unit of claim 16, wherein the flexible coupling aligns the rotor and driven shaft in a non-perfect alignment, and the rotor and the driven shaft are vibrationally decoupled.

19. A centrifugal compressor unit, comprising:

an assembly comprising an electric motor driving a compressor unit via a flexible coupling, the electric motor with a rotation speed of 6,000 to 16,000 rpm comprising a stator and a rotor, the compressor unit comprising a set of bladed wheels installed on a driven shaft, the flexible coupling connected to the rotor of the motor and to the driven shaft of the compressor unit; and a common casing holding the assembly tight to gas manipulated by the compressor with the coupling being within the casing and the gas surrounding the compressor and the flexible coupling, the casing composed of a casing assembly of casing elements fixed together, each casing element providing support and protection of the motor or a stage of the compression unit, wherein, the coupling is one of the group consisting of a diaphragm coupling, a flexible blade coupling, and a torsionally flexible shaft coupling, and the casing comprises an orifice that opens out facing a junction area between the rotor and the driven shaft to provide access to the coupling, and characterized in that each end of the driven shaft and the rotor is supported on an end bearing (40, 42, 55, 56) which suspends the respective end.

* * * * *